US009460877B2

(12) United States Patent
Ahn et al.

(10) Patent No.: US 9,460,877 B2
(45) Date of Patent: Oct. 4, 2016

(54) ELECTROMAGNETIC SWITCHING DEVICE

(71) Applicant: LSIS CO., LTD., Anyang-si, Gyeonggi-do (KR)

(72) Inventors: Tae Woon Ahn, Suwon-si (KR); Yeon Soon Choi, Gyeongsangbuk-do (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/569,297

(22) Filed: Dec. 12, 2014

(65) Prior Publication Data

US 2015/0187522 A1 Jul. 2, 2015

(30) Foreign Application Priority Data

Jan. 2, 2014 (KR) ..... 10-2014-0000302

(51) Int. Cl.

| | |
|---|---|
| ***H01H 13/04*** | (2006.01) |
| ***H01H 45/02*** | (2006.01) |
| ***H01H 50/04*** | (2006.01) |
| *H01R 13/629* | (2006.01) |

(52) U.S. Cl.

CPC ..... *H01H 45/02* (2013.01); *H01H 50/048* (2013.01); *H01R 13/62938* (2013.01)

(58) Field of Classification Search

CPC ..... H01H 45/02; B60R 16/0239
USPC ..... 335/202
See application file for complete search history.

(56) References Cited

U.S. PATENT DOCUMENTS 5,820,409 A 10/1998 Clark et al.
6,563,408 B1 * 5/2003 Miller ..... G01R 31/3278 335/128
6,911,884 B2 * 6/2005 Uotome ..... H01H 47/06 335/132
6,982,393 B2 * 1/2006 Matsui ..... H01R 13/62933 200/332
7,939,992 B2 * 5/2011 Ehrlich ..... H01H 57/00 200/239

(Continued)

FOREIGN PATENT DOCUMENTS

CN 203026458 U 6/2013
DE 4443349 6/1996

(Continued)

OTHER PUBLICATIONS

Korean Intellectual Property Office Application Serial No. 10-2014-0000302, Office Action dated Apr. 17, 2015, 5 pages.

(Continued)

*Primary Examiner* — Shawki S Ismail
*Assistant Examiner* — Lisa Homza
(74) *Attorney, Agent, or Firm* — Lee, Hong, Degerman, Kang & Waimey; Jonathan Kang; Richard Salfelder

(57) ABSTRACT

An electromagnetic switching device is provided that includes a junction box having an accommodating space formed to be one side open by side plates and a bottom plate and a relay having fixed contacts and movable contacts within a casing and detachable to and from the accommodating space, where the junction box includes a pair of protrusions that protrude from the side plates to an opposite side to the accommodating space, the relay includes a lever hinge-coupled to the casing and engaged by the pair of protrusions and the lever is configured to press the relay toward the bottom plate when rotating in one direction and to press the relay away from the bottom plate when rotating in an opposite direction, thereby enabling the relay to be easily detachable from the junction box.

11 Claims, 8 Drawing Sheets

(56) References Cited

U.S. PATENT DOCUMENTS

| | | | | |
|---|---|---|---|---|
| 2005/0098419 | A1 | 5/2005 | Matsui et al. | |
| 2014/0106580 | A1* | 4/2014 | Sato | B60R 16/0239 439/76.2 |

FOREIGN PATENT DOCUMENTS

| | | |
|---|---|---|
| DE | 29908612 | 8/1999 |
| EP | 1028494 | 8/2000 |
| JP | 2001-339816 | 12/2001 |
| JP | 2003-308770 | 10/2003 |
| JP | 2005-108767 | 4/2005 |
| JP | 2012-243559 | 12/2012 |
| KR | 10-2007-0094153 | 9/2007 |

OTHER PUBLICATIONS

European Patent Office Application Serial No. 14197603.5, Search Report dated Jun. 25, 2015, 8 pages.
Korean Intellectual Property Office Application Serial No. 10-2014-0000302, Notice of Allowance dated Jul. 30, 2015, 2 pages.
Japan Patent Office Application Serial No. 2014-265027, Office Action dated Dec. 8, 2015, 2 pages.
State Intellectual Property Office of the People's Republic of China Application Serial No. 201510004035.7, Office Action dated Jun. 3, 2016, 7 pages.

* cited by examiner

ELECTROMAGNETIC SWITCHING DEVICE

CROSS-REFERENCE TO RELATED APPLICATION

Pursuant to 35 U.S.C. §119(a), this application claims the benefit of earlier filing date and right of priority to Korean Application No. 10-2014-0000302 filed on Jan. 2, 2014, the contents of which are incorporated by reference herein in its entirety.

FIELD OF THE INVENTION

The present invention relates to an electromagnetic switching device, more particularly, to an electromagnetic switching device in which a relay is detachably mounted on a junction box.

DESCRIPTION OF THE CONVENTIONAL ART

As is well known in the art, an electromagnetic switching device is a type of electric contact breaking device which is configured to supply or cut off an electric power, and may be used in various industrial appliances, machines, vehicles, and the like.

FIG. 1 is a perspective view illustrating a conventional electromagnetic switching device and remover, FIG. 2 is a perspective view illustrating a relay of FIG. 1, and FIG. 3 is a sectional view illustrating a state that the remover of FIG. 1 has been inserted between a junction box and the relay.

Referring to FIGS. 1 through 3, the conventional electromagnetic switching device includes a junction box 10, and a relay 20 disposed in the junction box 10 and configured to open or close a circuit.

The relay 20 includes a terminal part 26 having a contact portion (not shown) disposed within an casing 22 and extended from the contact portion to outside of the casing 22 and connected to the junction box 10 in an electrically conductive manner.

The casing 22 includes a pair of hook protrusions 24 which are configured to fixedly mount the relay 20 to the junction box 10.

The junction box 10 includes a mounting portion 12 on which the relay 20 is mounted.

The mounting portion 12 includes a pair of hook recesses 14 through which the pair of hook protrusions 24 are inserted.

Further, the mounting portion 12 is configured such that a gap between the pair of hook recesses 14 and the casing 22 is not generated.

Under such a configuration, the relay 20 can be fixedly mounted on the mounting portion 12 of the junction box 10 since the pair of hook protrusions 24 are inserted in the pair of hook recesses 14 to thus be hooked therein and the pair of hook recesses 14 contact and support the junction box 10.

Meanwhile, the relay 20 may be separated from the junction box 10 for repairing and maintenance purposes and then mounted thereto.

The relay 20 mounted on the junction box 10 may be separated from the junction box 10 by a remover 30.

The remover 30 is an exclusive tool for separating the relay 20 from the junction box 10, which is separately provided from the electromagnetic switching device.

The remover 30 includes handle portions 32 with which a user may grasp and clamp portions 34 which are configured to hold the relay 20, and is formed in the type of pliers.

Each of the clamp portions 34 has an end portion 34*a* which is formed by a corner cutoff process so as to be inclined toward an insertion direction.

Further, the clamp portion 34 has a hook hole 34*b* in which the hook protrusion 24 is inserted to be caught.

The remover 30 is inserted such that the clamp portion 34 may move into a space formed between the casing 22 and the pair of hook recesses 14.

When the remover 30 is inserted, the pair of hook recesses 14 are widen in a direction to become distant from each other by the clamp portion 34.

Then, the remover 30 holds the casing 22 with its clamp portion 34 and at this moment, the pair of hook protrusions 24 are inserted into and caught by the hook holes 34*b* of the clamp portions 34.

The remover 30, which holds the casing 22, lifts up the relay 20 to separate the relay 20 from the junction box 10.

Meanwhile, in such a conventional electromagnetic switching device, there has been a disadvantage in that it is difficult to separate the relay 20 from the junction box 10 in a case where the remover 30 is not provided.

Further, when the relay 20 is separated from the junction box 10 by the remover 30, the pair of hook recesses 14 may be permanently deformed in a direction to become distant from each other, or a peripheral portion of the pair of hook protrusions 24 of the casing 22 may be permanently deformed in a direction toward inside of the casing 22. Thus, there may be a gap between the peripheral portion of the pair of hook protrusions 24 of the casing 22 and the pair of hook recesses 14 when the relay 20 is reassembled to the junction box 10. As a result, the relay 20 may be moved from the junction box 10 so that a contact failure may occur between the relay 20 and the junction box 10, and also the relay 20 may be inadvertently separated from the junction box 10 because the pair of hook protrusions 24 are not securely caught by the pair of hook recesses 14.

SUMMARY OF THE INVENTION

An object of the present invention is to provide an electromagnetic switching device, in which a relay can be easily mounted to or separated from a junction box without any additional tool.

Another object of the present invention is to provide an electromagnetic switching device, in which a relay is not moved or unintentionally separated from a junction box.

To achieve these and other advantages and in accordance with the purpose of this specification, as embodied and broadly described herein, there is provided an electromagnetic switching device, including a junction box having an accommodating space formed to be open at one side by side plates and a bottom plate; and a relay configured to be mounted to or separated from the accommodating space and having a movable contact and a fixed contact positioned within an casing and configured to be in contact with each other or separable from each other.

The junction box may include a pair of protrusions provided on the side plates at an outside of the accommodating space.

The relay may include a lever hinge-coupled to the casing and caught by the protrusions.

The lever may be configured to press the relay toward the bottom plate when rotating in one direction and press the relay in a direction to become distant from the bottom plate when rotating in an opposite direction.

The lever may include a handle; and a pair of lever plates bent from both ends of the handle and formed in a flat plate shape which face each other.

Each of the lever plates may be hinge-coupled to side walls of the casing which face the side plates and caught by the protrusions.

The handle may be configured to be spaced from the casing when the lever is rotated in the opposite direction.

Each of the lever plates may have an arc-shaped slit at an opposite direction based on a hinge-coupling portion with the side wall.

The arc-shaped slit may be formed to protrude toward an opposite side to the handle based on the hinge-coupling portion.

The arc-shaped slit may be configured such that a length from the hinge-coupling portion to one end of the arc-shaped slit is longer than a length from the hinge-coupling portion to another end of the arc-shaped slit.

The one end of the arc-shaped slit may be configured to open.

The protrusions may be inserted into the arc-shaped slit through the one end of the arc-shaped slit, moved to the another end of the arc-shaped slit when the lever is rotated in the one direction, and moved to the one end of the arc-shaped slit when the lever is rotated in the opposite direction.

The junction box and the relay may be configured to satisfy the following conditions, in which a length from the bottom plate to the protrusion is the same as a length obtained by subtracting a length from the hinge-coupling portion to the another end of the arc-shaped slit from a length from the hinge-coupling portion to a bottom wall of the casing, and a length from the bottom plate to the protrusion is longer than a length obtained by subtracting a length from the hinge-coupling portion to the one end of the arc-shaped slit from a length from the hinge-coupling portion to the bottom wall of the casing.

The relay may be configured to satisfy the following condition, in which a length from the hinge-coupling portion to the handle is longer than a length from the hinge-coupling portion to the one end of the arc-shaped slit.

The lever plate may further include rib which is configured to protrude from two portions forming the one end of the arc-shaped slit toward an opposite direction to the casing and to connect and support the two portions.

The rib may include a pair of bent portions which are bent toward an opposite direction to the casing from the two portions, respectively; and a connecting portion configured to connect the pair of bent portions.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENT

Figure 1:
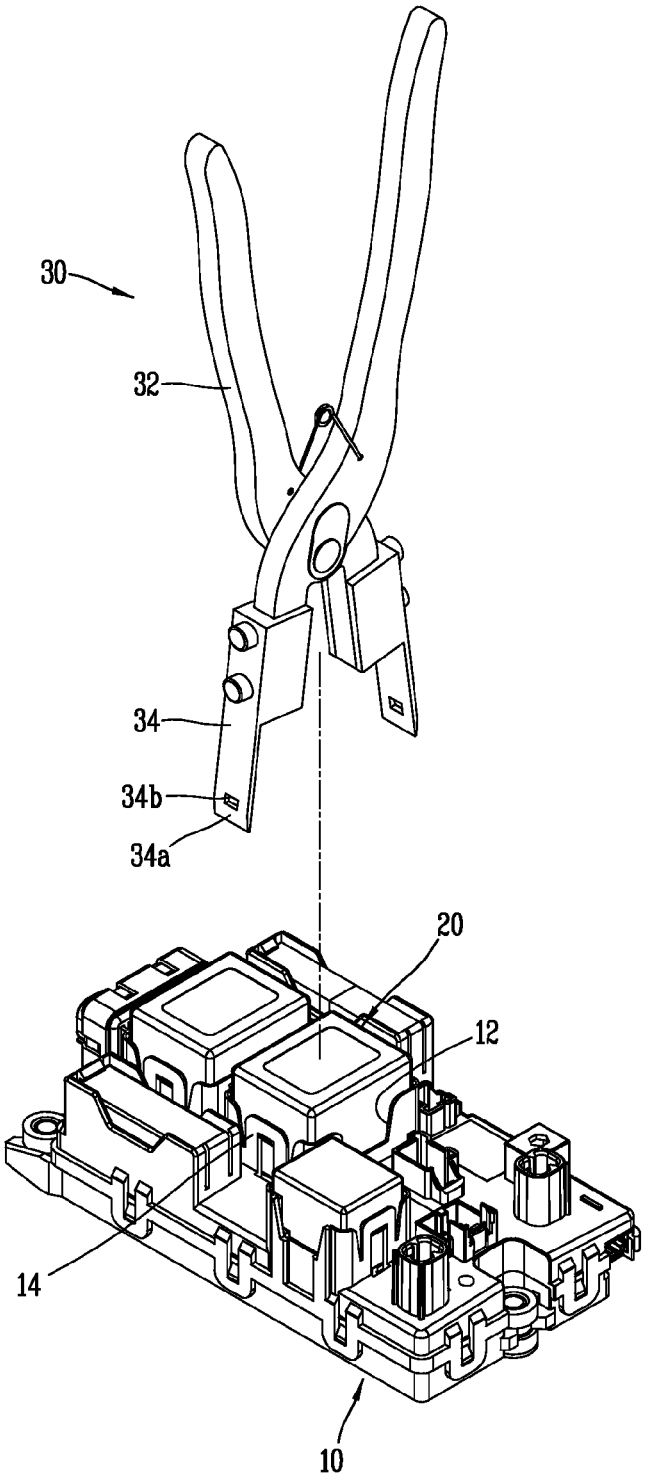
FIG. 1 CONVENTIONAL ART
FIG. 1 is a perspective view illustrating a conventional electromagnetic switching device and remover.
Figure 2:
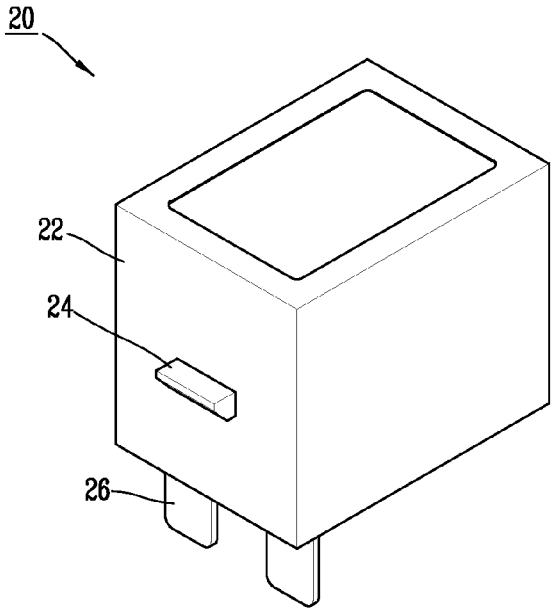
FIG. 2 CONVENTIONAL ART
FIG. 2 is a perspective view illustrating the remover of FIG. 1.
Figure 3:
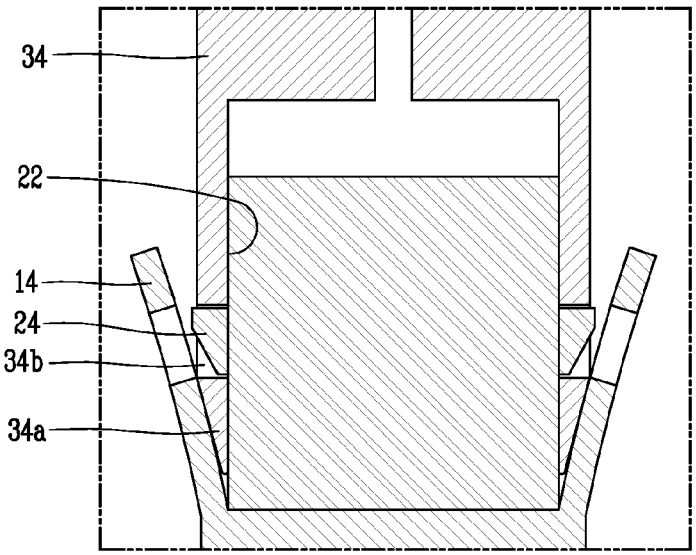
FIG. 3 CONVENTIONAL ART
FIG. 3 is a sectional view illustrating a state that the remover of FIG. 1 is inserted between a junction box and a relay.

Hereinafter, a preferred embodiment of an electromagnetic switching device according to an embodiment of the present invention will now be described in detail with reference to the accompanying drawings.

As shown in FIGS. 4 through 9, the electromagnetic switching device according to an embodiment of the present invention may include a junction box 100 having an accommodating space formed by side plates 130 and a bottom plate 120 to be open at its one side; and a relay 200 having fixed contacts (not shown) and movable contacts (not shown) positioned in an casing 210 and contactable to or separable from each other, and configured to be mounted to or separated from the accommodating space 110.

The junction box 100 may be configured such that the accommodating space 110 corresponds to the shape of the casing 210.

In this case, the casing 210 is formed in a rectangular shape and the accommodating space 110 may be also formed in a rectangular shape.

To this end, the junction box 100 includes a rectangular bottom plate 120, a plurality of side plates 130 which stand at four sides so that the rectangular accommodating space 110 can be provided.

The side plates 130 may include a pair of long side plates 140 which stand at long sides of the bottom plate 120 to face each other.

Further, the side plates 130 may include a pair of short side plates 150 which stand at short sides of the bottom plate 120 to face each other.

The pair of long side plates 140 and the pair of short side plates 150 may be perpendicularly connected to each other at each side.

The junction box 100 may include a pair of protrusions 142 formed on the side plates 130 at outside of the accommodating space 110.

In the embodiment of the present invention, the pair of protrusions 142 may be provided on the pair of long side plates 140.

The pair of protrusions 142 may be provided at an upper central portion of the long side plates 140 in a widthwise direction and at an upper portion of the long side plates 140 in a longitudinal direction.

Here, the widthwise direction means a direction parallel to the bottom plate 120 and the longitudinal direction means a direction perpendicular to the bottom plate 120, and the upper portion means a direction which becomes distant from the longitudinal center of the bottom plate 120.

Each of the pair of protrusions 142 may include a separation preventing portion 142*a* which is formed to protrude along a circumferential direction of the protruded end of the long side plates 140.

The separation preventing portion 142*a* is configured to prevent a lever plate 290 from being separated from the protrusion 140 in a direction that the protrusion 140 is protruded by being caught by the separation preventing portion 142*a* when the protrusion 140 is inserted into an arc-shaped slit 294.

And the junction box 100 may include a plurality of junction box terminal parts 122 which are protruded from the bottom plate 120 to an opposite direction to the accommodating space 110.

The junction box terminal parts 122 may be connected to a relay terminal part 222 in a conductive manner, which are protruded through the bottom plate 120 when the relay 200 is mounted to the junction box 100. The relay 200 may include a lever 270 which is hinge-coupled to the casing 210 and caught by the protrusion 142. The lever 270 may be configured to compress the relay 200 toward the bottom plate 120 when rotating in one direction and pushes the relay 200 to become distant from the bottom plate 120 when rotating in an opposite direction.

The casing 210 may be configured to be in a rectangular shape which includes a bottom wall 220 forming a bottom surface, side walls 230 forming side surfaces, and an upper wall 260 forming an upper surface.

The bottom wall 220 may include a plurality of relay terminal parts 222 which are protruded to outside of the casing 210 from a contact part (not shown) which is disposed within the casing 210 and includes the fixed contact and the movable contact.

The side walls 230 may include a pair of long side walls 240 which are configured to connect long sides of the bottom wall 220 and long sides of the upper wall 260 to each other.

Further, the side wall 230 may include a pair of short side walls 250 which are configured to connect short sides of the bottom wall 220 and short sides of the upper wall 260 to each other.

Figure 10:
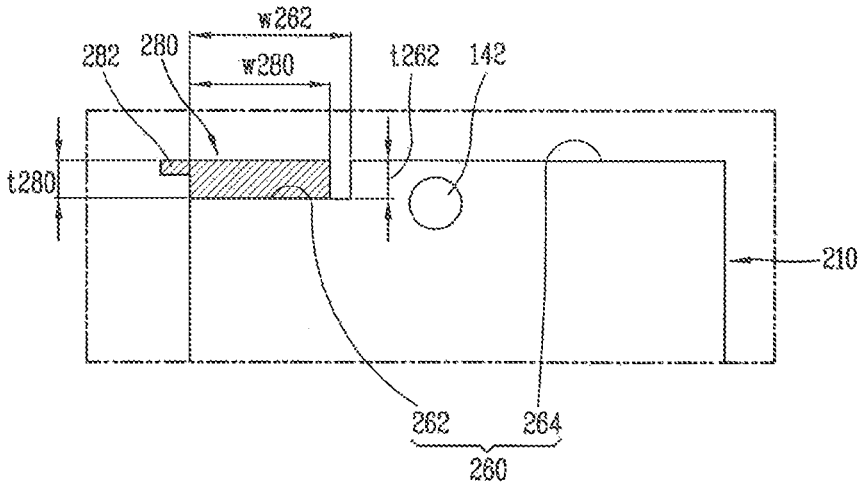
FIG. 10 is a sectional view taken along line III-Ill of FIG. 7.

The upper wall 260 may be configured in a stair-shape so that a handle 280 of the lever 270 may be accommodated therein and overlapped therewith when the relay 200 is mounted to the junction box 100, as shown in FIG. 10.

The upper wall 260 may be configured to have one end 262 formed to be stepped down from another end 264 toward the bottom wall 220.

The one end 262 of the upper wall 260 may be formed to have a predetermined width (w262) and a predetermined depth (t262).

Here, the width (w262) of the one end 262 of the upper wall 260 indicates a distance from a corner where the one end 262 of the upper wall 260 meets the side wall 250, to a boundary portion between the one end 262 of the upper wall 260 and the another end 264 of the upper wall 260.

The width (w262) of the one end 262 of the upper wall 260 may be formed to be larger than a width (w280) of a handle 280 which will be described hereafter.

Further, the depth (t262) of the one end 262 of the upper wall 260 indicates a distance that the one end 262 of the upper wall 260 is stepped down from the another end 264 of the upper wall 260.

The depth (t262) of the one end 262 of the upper wall 260 may be formed to be larger than a thickness (t280) of the handle 280.

Under such a configuration, the bottom wall 220 may face the bottom plate 120 and the pair of long side walls 240 may face the pair of long side plates 140, and the pair of short side walls 250 may face the pair of side plates 150 when the relay 200 is mounted to the junction box 100.

Further, the relay terminal part 222 may be connected to the junction box terminal part 122 through the bottom plate 120 in an electrically conductive manner.

Here, the casing 210 and the accommodating space 110 may be configured such that a gap is not formed between the side wall 230 and the side plate 130 so that the casing 210 may not be moved in a horizontal direction of the bottom plate 120 within the accommodating space 110.

The lever 270 may include a handle 280 formed to be extended in a lengthwise direction and a pair of lever plates 290 formed by being bent from both ends of the handle 280 to face each other. The lever plate 290 may be hinge-coupled to the side walls 230.

In the embodiment of the present invention, the handle 280 may be formed in a rectangular plate shape.

The handle 280 may be configured such that a width (w280) is shorter than a length (1280) and a thickness (t280) is shorter than a width (w80).

Here, the length (1280) of the handle 280 is a size of the long side of the handle 280, the width (w280) of the handle 280 is a size of the short side of the handle 280, and the thickness (t280) of the handle 280 is a size in a direction perpendicular to a plane formed by the long and short sides of the handle 280. The pair of lever plates 290 may be formed by being vertically bent from both ends of the handle 280, respectively, and extended in a direction toward the width (w280) of the handle 280.

Assuming that the extension direction of the lever plate 290 is a lengthwise direction of the lever plate 290, the lever plate 290 may have a length equal to the length of the long side walls 240 in the longitudinal direction.

Further, the central portion of the lever plate 290 in a longitudinal direction may be hinge-coupled to the long side walls 240 at an upper portion in a longitudinal direction.

Here, the longitudinal direction of the long side walls 240 is a direction vertical to the bottom wall 220, and the upper longitudinal direction of the long side walls 240 is indicative of a direction to become distant from the center of the longitudinal direction from the bottom wall 220.

Figure 4:
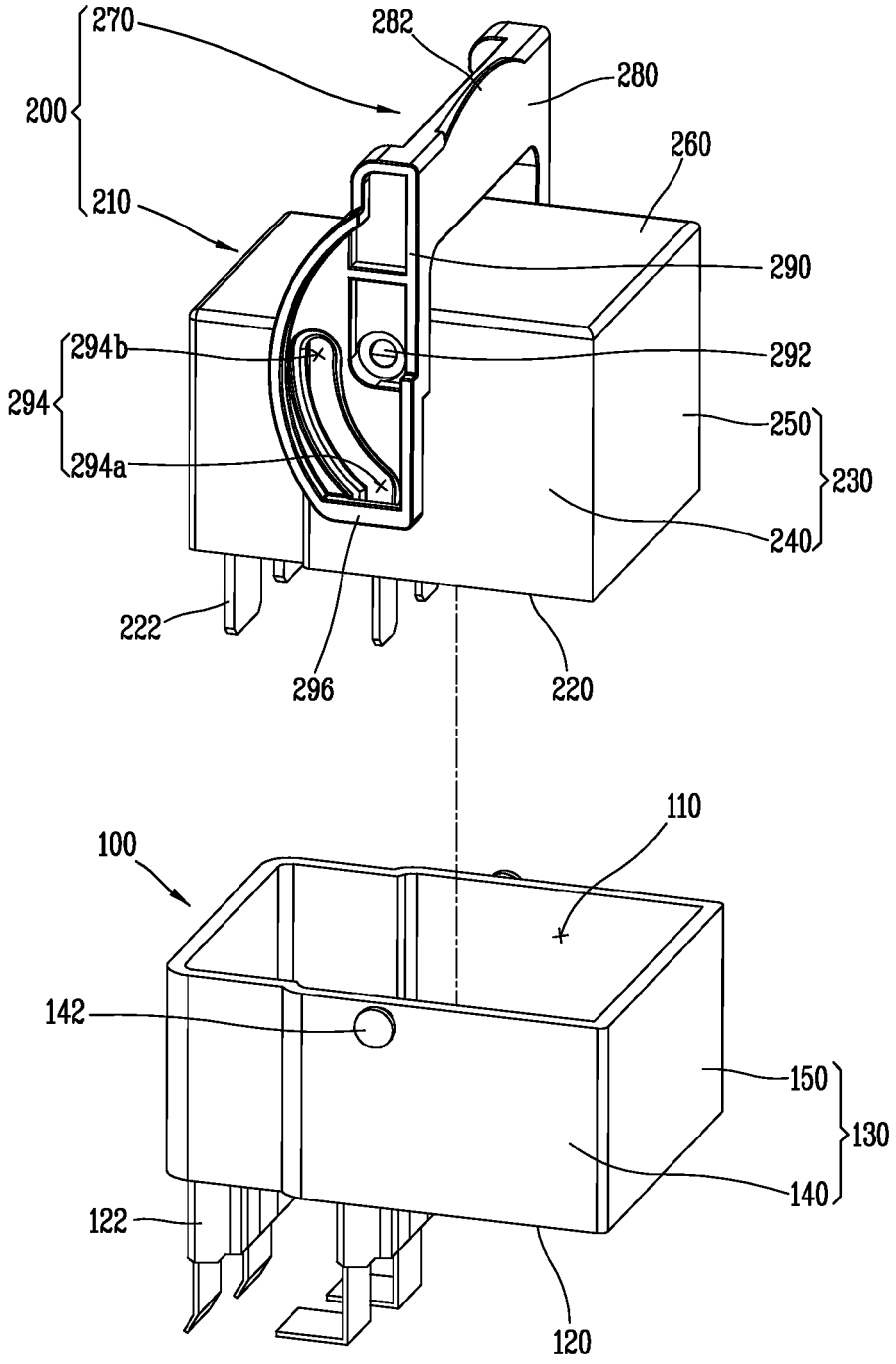
FIG. 4 is a perspective view illustrating an electromagnetic switching device according to an embodiment of the present invention.

Thus, when the lever is rotated so that the longitudinal direction of the lever plate 290 is vertical to the bottom wall 220, as shown in FIG. 4, the handle 280 may be protruded from the casing 210, more specifically, from the upper wall 260 to be spaced therefrom.

As the handle 280 is protruded from the upper wall 260 of the casing 210, a user may easily grasp the handle 280.

Figure 7:
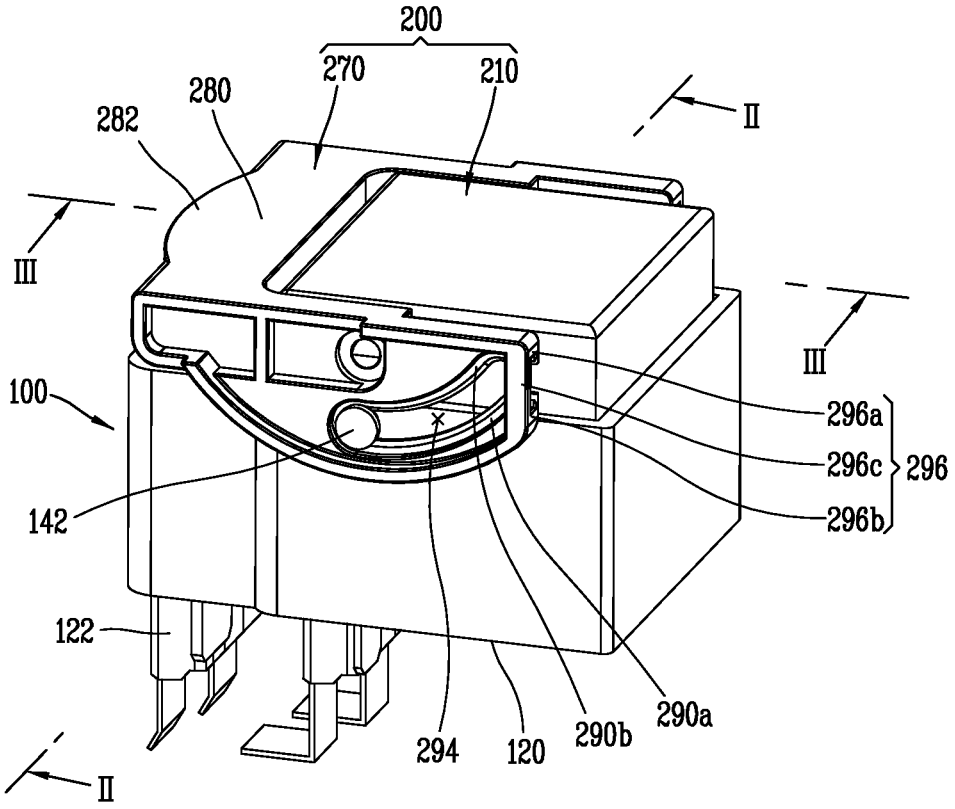
FIG. 7 is a perspective view illustrating a state that a lever of FIG. 6 has been further rotated so that a relay is mounted to a junction box.

Further, the lever 270 may be overlapped with the casing 210 so as not to be protruded from the casing 210 when the lever plate 290 is rotated in a longitudinal direction to be parallel to the bottom wall 220, as shown in FIG. 7.

That is, the handle 280 may be accommodated in the casing 210, more specifically, at one end 262 of the upper wall 260.

Further, both the upper ends of the lever plate 290 in a longitudinal direction may be configured not to be protruded more than the casing 210.

The lever 270 which has been overlapped with the casing 210 may be configured not to be interfered with other elements (not shown) of the equipment (not shown) to which the electromagnetic switching device is mounted, when the relay 200 is mounted to the junction box 100.

Here, the lever 270 may include a protrusion portion 282 protruded from the handle 280 which enables an easy grasping when the handle 280 is accommodated in the one end 262 of the upper wall 260.

The pair of lever plates 290 may include an arc-shaped slit 294 which is formed at an opposite side to the handle 280 based on a hinge-coupling portion 292 of the side wall 240, respectively.

The arc-shaped slit 294 may be formed in a convex manner at an opposite side to the handle 280 based on the hinge-coupling portion 292.

Further, the arc-shaped slit 294 may include one end 294*a* which is formed at an opposite side to the handle 280 based on the hinge-coupling portion 292 in a longitudinal direction of the lever 270.

Further, the arc-shaped slit 294 may include another end 294*b* which is formed at an axis vertical to the lever 270 in a longitudinal direction from the hinge-coupling portion 292.

Further, the arc-shaped slit 294 may be configured such that a length (A) from the hinge-coupling portion 292 to the one end 294*a* of the arc-shaped slit 294 is longer than a length (B) from the hinge-coupling portion 292 to the another end 294*b* of the arc-shaped slit 294.

Under such a configuration, the arc-shaped slit 294 may be configured to have a center of curvature which is positioned at an opposite side to the another end 294*b* of the arc shaped aperture 294 based on the hinge-coupling portion 292.

Further, the arc-shaped slit 294 may be configured such that its one end 294*a* is opened and its another end 294*b* is closed.

The lever plate 290 may be configured to have one end 290*a* divided by the arc shaped aperture 294 in a longitudinal direction.

Each of the protrusions 142 may be inserted into the arc-shaped slit 294 through the one end 294*a* of the arc-shaped slit 294.

The lever plate 290 may further include a rib 296 which is protruded from the first and second ends 290*a* and 290*b*, which form the first end 294*a* of the arc-shaped slit 294, toward an opposite side to the casing 210 and configured to support the first and second ends 290*a* and 290*b* of the lever plate 290.

the rib 296 may include a pair of bent portions 296*a* and 296*b* which are bent from the first and second ends 290*a* and 290*b* of the lever plate 290 toward an opposite side to the casing 210 and a connection part 296*c* which is configured to connect the pair of the bent portions 296*a* and 296*b* to each other.

Under such a configuration of the rib 296, the first and second ends 290*a* and 290*b* of the lever plate 290 can not be widen.

Here, the junction box 100 and the relay 200 may be configured such that a length (D) from the bottom plate 120 to the protrusion 142 is equal to a length (B) obtained by subtracting a length from the hinge-coupling portion 292 to the another end 294*b* of the arc-shaped slit 294 from a length (C) from the hinge-coupling portion 292 to the bottom wall 220.

Further, the junction box 100 and the relay 200 may be configured such that a length (D) from the bottom plate 120 to the protrusion 142 is longer than a length (B) obtained by subtracting a length from the hinge-coupling portion 292 to the one end 294*a* of the arc-shaped slit 294 from a length (C) from the hinge-coupling portion 292 to the bottom wall 220.

Hereinafter, the operation and effect of the electromagnetic switching device according to an embodiment of the present invention will be described.

First, an operation to mount the relay 200 to the junction box 100 will be described.

As shown in FIG. 4, the relay 200 is prepared such that the lever plate 290 is placed in a vertical direction to the bottom wall 220 in a longitudinal direction.

Under such a state, the relay 200 may be positioned over the junction box 100 in a manner that the bottom wall 220 faces the bottom plate 110 and the one end 294*a* of the arc-shaped slit 294 faces the protrusion 142.

At this moment, the handle 280 is spaced from the casing 210, more specifically, from the upper wall 260 and protruded in parallel to a rotation axis of the hinge-coupling portion 292.

By this configuration, a user may grasp the handle 280 and easily move the relay 200.

Figure 5:
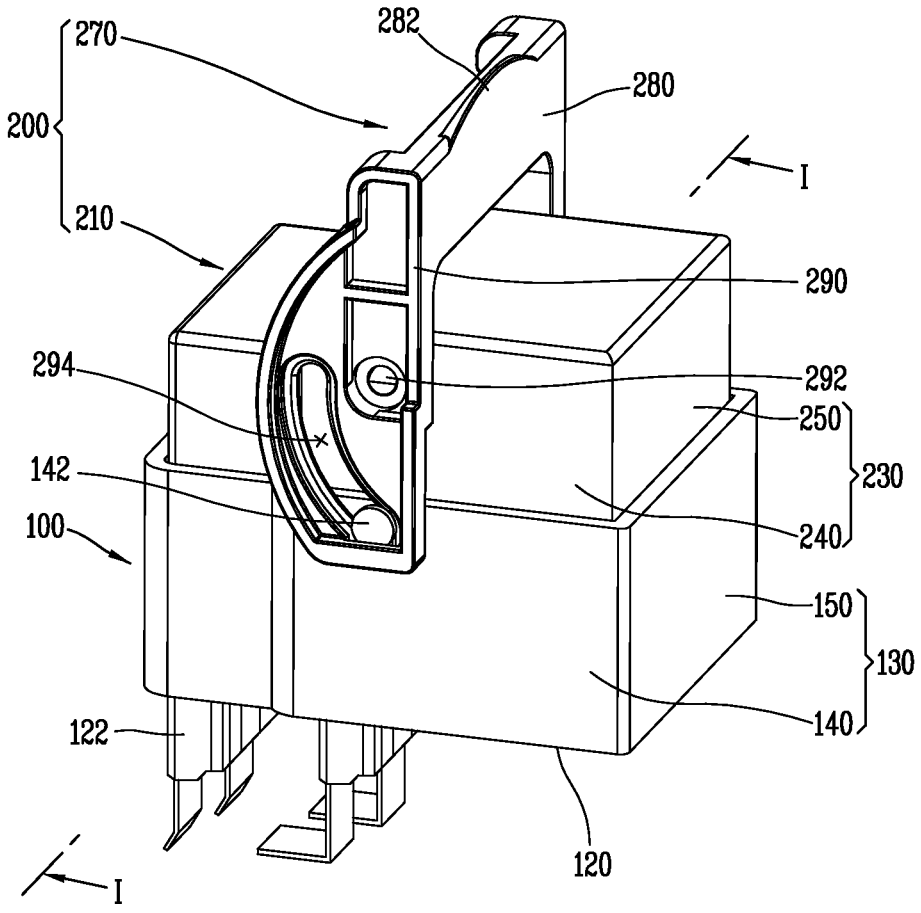
FIG. 5 is a perspective view illustrating a state that a protrusion of FIG. 4 has been inserted into one end of an arc-shaped slit.
Figure 8:
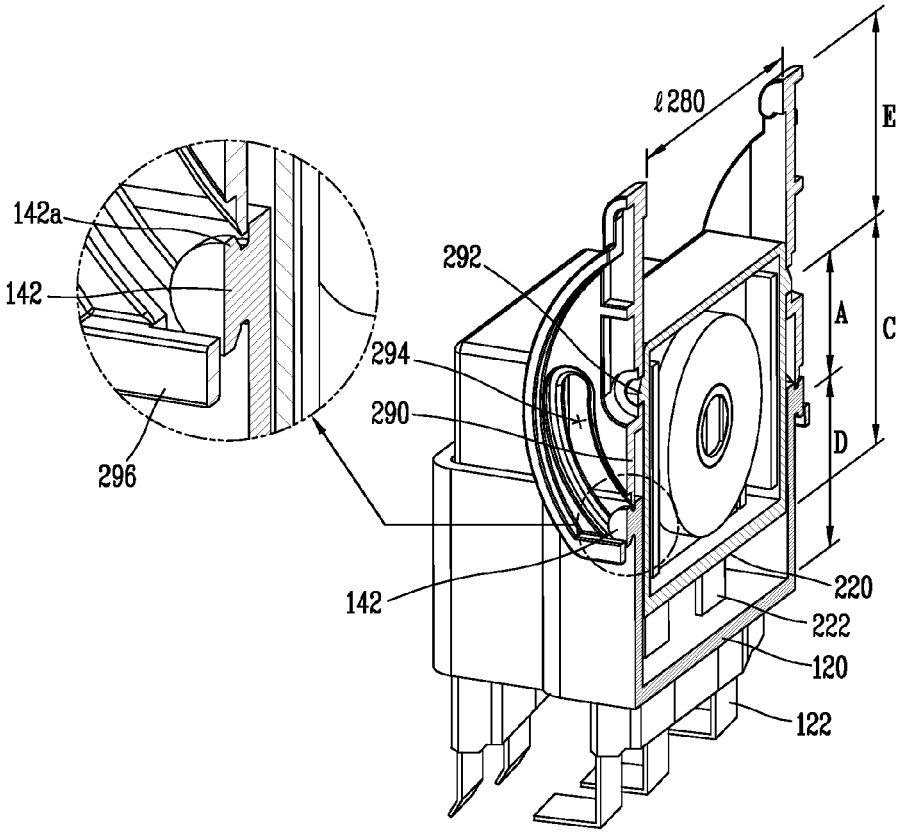
FIG. 8 is a perspective view taken along line I-I of FIG. 5.

The relay 200 which is prepared as described above, may be placed on the junction box 100, as shown in FIGS. 5 and 8.

At this moment, the bottom wall 220 may be spaced from the bottom plate 120 and the protrusion 142 may be inserted into the one end 294*a* of the arc-shaped slit 294.

Here, since the junction box 100 and the relay 200 are configured such that a length (D) from the bottom plate 120 to the protrusion 142 is longer than a length (B) obtained by subtracting a length from the hinge-coupling portion 292 to the one end 294*a* of the arc-shaped slit 294 from a length (C) from the hinge-coupling portion 292 to the bottom wall 220, and a gap between the bottom wall 220 and the bottom plate 120 is larger than zero when the protrusion 142 is positioned at the one end 294*a* of the arc-shaped slit 294. That is, the bottom wall 220 and the bottom plate 120 may be separated from each other.

Figure 6:
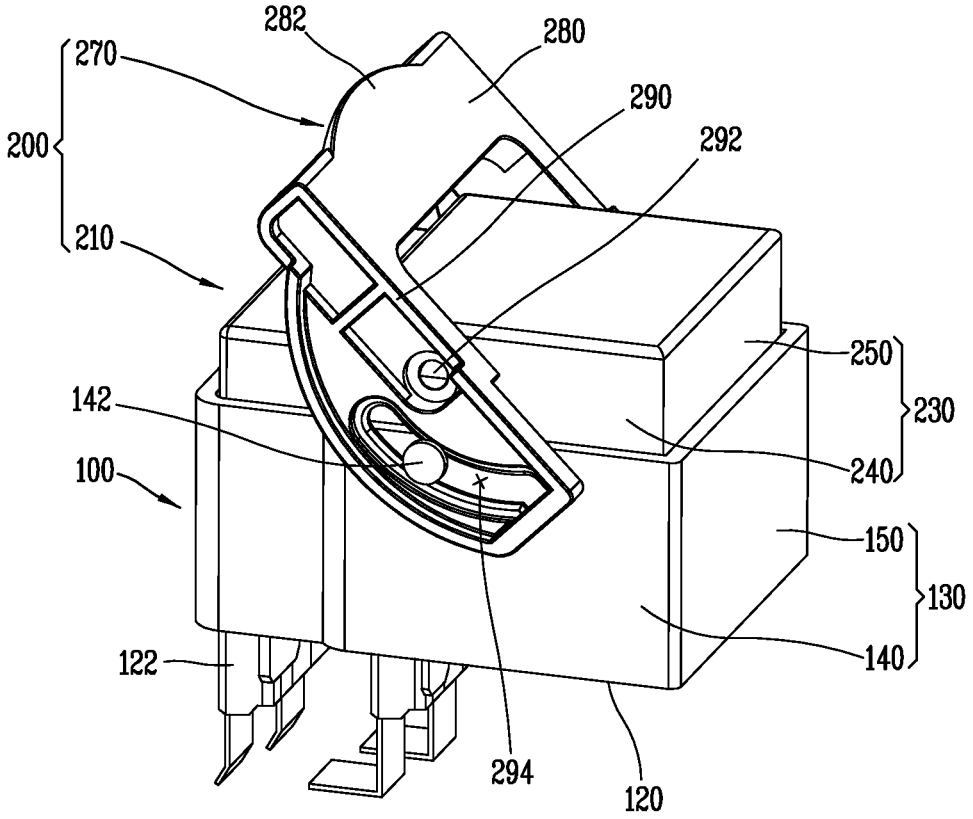
FIG. 6 is a perspective view illustrating a state that a lever of FIG. 5 has been rotated.

Under the state as above, when the handle 180 is pressed, the lever 200 may be rotated in a counterclockwise direction, as shown in FIGS. 6 and 7.

When the lever 200 is rotated, the protrusion 142 may be moved from the one end 294*a* of the arc-shaped slit 294 to the another end 294*b* of the arc-shaped slit 294.

Here, the arc-shaped slit 294 may be configured such that a length (B) from the hinge-coupling portion 292 to the another end 294*b* of the arc-shaped slit 294 is shorter than a length (A) from the hinge-coupling portion 292 to the one end 294*a* of the arc-shaped slit 294.

Figure 9:
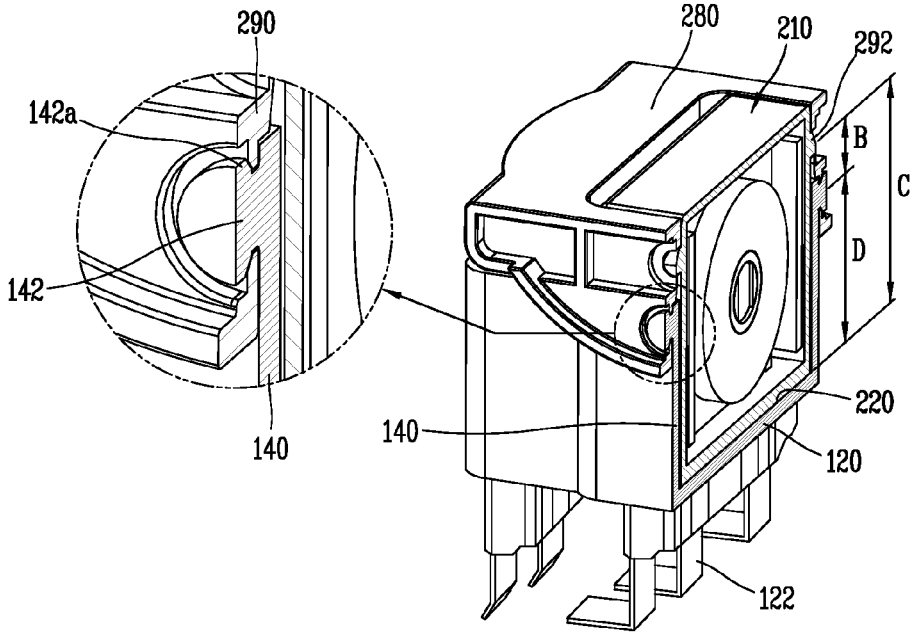
FIG. 9 is a perspective view taken along line II-II of FIG. 7.

As such, as the protrusion 142 moves from one end 294*a* of the arc-shaped slit 294 to another end 294*b* of the arc-shaped slit 294, the gap between the bottom wall 220 and the bottom plate 120 becomes narrower, and thereby the bottom wall 220 and the bottom plate 120 may be in contact with each other, as shown in FIG. 9. That is, the relay 200 may be completely mounted to the junction box 100.

The junction box 100 and the relay 200 may be configured such that a length (D) from the bottom plate 120 to the protrusion 142 is equal to a length (B) obtained by subtracting a length from the hinge-coupling portion 292 to another end 294*b* of the arc-shaped slit 294 from a length (C) from the hinge-coupling portion 292 to the bottom wall 220, and there is no gap between the bottom wall 220 and the bottom plate 120 when the protrusion 142 is positioned at the another end 294*b* of the arc-shaped slit 294. In other words, the bottom wall 220 and the bottom plate 120 may come into contact with each other.

Moreover, when the relay 200 is mounted to the junction box 100, the lever 270 is overlapped to the casing 210 so as not to be protruded from the external line of the casing 210.

However, although the lever 270 is overlapped to the casing 210, the protrusion portion 280 may be protruded from the casing 210, more specifically, from a corner that the short side wall 250 meets the one end 262 of the upper wall 260.

Under such a configuration, when a user rotates the lever 270 in order to separate the relay 200 from the junction box 100, it is possible to easily rotate the lever 270 by grasping the protrusion portion 282.

Meanwhile, in the principle of levers, the hinge-coupling portion 292 may serve as a fulcrum, the handle 280 may serve as a point of power, and a contact portion of the protrusion 142 and the arc-shaped slit 294 may serve as a point of action.

Meanwhile, the lever 270 may be configured such that a length (E) from the hinge-coupling portion 292 to the handle 280 is longer than a length (A) from the hinge-coupling portion 292 to the one end 294*a* of the arc-shaped slit 294.

Further, the lever 270 may be configured such that a length (E) from the hinge-coupling portion 292 to the handle 280 is longer than a length (B) from the hinge-coupling portion 292 to the another end 294*b* of the arc-shaped slit 294.

By such a configuration, a force applied to a contact portion of the protrusion 142 and the arc-shaped slit 294 may be larger than a force applied to the handle (a point of power) 280.

As a result, it is possible to strongly mount the relay 200 to the junction box 100, and easily separate the relay 200 from the junction box 100, with a relatively small power.

As shown in FIG. 7, the relay 200 mounted to the junction box 100 may be separated from the junction box 100 in a reverse order to the above.

Here, according to the electromagnetic switching device of the present invention, when the lever 270 which is hinge-coupled to the relay 200 is rotated in one direction in a caught state by the protrusion 142 of the junction box 100, it is possible to press the relay 200 toward the bottom plate 120 of the junction box 100. Further, when the lever 270 which is hinge-coupled to the relay 200 is rotated in an opposite direction in a state of being caught by the protrusion 142 of the junction box 100, it is possible to push the relay 200 in a direction to become distant from the bottom plate 120 of the junction box 100. Therefore, it is possible to mount or separate the relay 200 to or from the junction box 100.

Further, although the relay 200 is repeatedly mounted to or separated from the junction box 100, a gap is not generated between the relay 200 and the junction box 100, more specifically, between the side wall 230 and the side plate 130. As a result, the relay 200 can not be moved or separated from the junction box 100.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic switching device, comprising:

a junction box comprising an accommodating space formed by side plates and a bottom plate such that the accommodating space has one open side; and a relay comprising a casing that is detachable from the accommodating space, wherein the junction box further comprises a pair of protrusions from the side plates, the pair of protrusions provided on opposite sides of the junction box and protruding away from the accommodating space wherein the relay further comprises a lever hinge-coupled to the casing and engaged by the pair of protrusions, wherein the lever is configured to press the relay toward the bottom plate when rotating in a first direction and to push the relay away from the bottom plate when rotating in a second direction opposite to the first direction, wherein the casing comprises a bottom wall, side walls, and an upper wall, wherein a first end of the upper wall is stepped down and toward the bottom wall from a second end of the upper wall and wherein the lever comprises a handle that is accommodated in the first end of the upper wall.

2. The electromagnetic switching device of claim 1, wherein the lever further comprises:

a pair of lever plates formed by bending both ends of the handle to face each other, each of the pair of lever plates hinge-coupled to one of the side walls of the casing which face the side plates of the junction box and are engaged by the pair of protrusions.

3. The electromagnetic switching device of claim 2, wherein the handle is separated from the casing when the lever is rotated in the second direction.

4. The electromagnetic switching device of claim 2, wherein:

each of the pair of lever plates comprises an arc-shaped slit, the arc-shaped slit of a first of the pair of lever plates located at an opposite side of the handle from the arc-shaped slit of a second of the pair of lever plates as a result of the hinge-coupling of each of the pair of lever plates to one of the side walls of the casing; and the arc-shaped slit of each of the pair of lever plates is convexly formed.

5. The electromagnetic switching device of claim 4, wherein the arc-shaped slit of each of the pair of lever plates is formed such that a length from a hinge-coupling portion of the corresponding lever plate to a first end of the corresponding arc-shaped slit is longer than a length from the hinge-coupling portion to a second end of the corresponding arc-shaped slit.

6. The electromagnetic switching device of claim 5, wherein the first end of the arc-shaped slit of each of the pair of lever plates is an open end.

7. The electromagnetic switching device of claim 6, wherein each of the pair of protrusions is inserted into a corresponding arc-shaped slit through the first end of the corresponding arc-shaped slit, moved to the second end of the corresponding arc-shaped slit when the lever is rotated in the first direction, and moved to the first end of the corresponding arc-shaped slit when the lever is rotated in the second direction.

8. The electromagnetic switching device of claim 7, wherein:

a length from the bottom plate to each of the pair of protrusions is same as a length obtained by subtracting a length from the corresponding hinge-coupling portion to the second end of the corresponding arc-shaped slit from a length from the corresponding hinge-coupling portion to the bottom wall of the casing; and a length from the bottom plate to each of the pair of protrusions is longer than a length obtained by subtracting a length from the corresponding hinge-coupling portion to the first end of the corresponding arc-shaped slit from a length from the corresponding hinge-coupling portion to the bottom wall of the casing.

9. The electromagnetic switching device of claim 7, wherein a length from each hinge-coupling portion to the handle is longer than a length from the hinge-coupling portion to the first end of the corresponding arc-shaped slit.

10. The electromagnetic switching device of claim 7, wherein each of the pair of lever plates further comprises a rib configured to protrude from two portions forming the first end of the corresponding arc-shaped slit toward an opposite direction of the casing and to connect and support the two portions.

11. The electromagnetic switching device of claim 10, wherein each rib comprises:

a pair of bent portions each of which is bent toward the opposite direction of the casing from one of the two portions; and a connecting portion configured to connect the pair of bent portions.

* * * * *